US009089785B2

(12) United States Patent
Orem et al.

(10) Patent No.: US 9,089,785 B2
(45) Date of Patent: Jul. 28, 2015

(54) BUBBLE-BLOWING APPARATUS

(71) Applicant: Crayola LLC, Easton, PA (US)

(72) Inventors: Christopher P. Orem, Easton, PA (US); Thomas R. Rau, Easton, PA (US)

(73) Assignee: Crayola, LLC, Easton, PA (US)

( * ) Notice: Subject to any disclaimer, the term of this patent is extended or adjusted under 35 U.S.C. 154(b) by 249 days.

(21) Appl. No.: 13/633,552

(22) Filed: Oct. 2, 2012

(65) Prior Publication Data

US 2014/0094081 A1 Apr. 3, 2014

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 446/15–21
See application file for complete search history.

(56) References Cited

U.S. PATENT DOCUMENTS

| | | | | |
|---|---|---|---|---|
| 3,060,626 | A * | 10/1962 | Panico, Jr. | 446/20 |
| 3,064,387 | A | 11/1962 | Campbell | |
| 5,498,191 | A * | 3/1996 | DeMars | 446/15 |
| 5,613,890 | A | 3/1997 | DeMars | |
| 6,572,427 | B1 * | 6/2003 | Thai | 446/15 |
| 6,860,782 | B2 * | 3/2005 | Hornsby et al. | 446/15 |
| 6,921,312 | B2 | 7/2005 | Thai | |
| 7,056,182 | B2 * | 6/2006 | Wan | 446/15 |
| 7,059,930 | B2 * | 6/2006 | Choi | 446/15 |
| 7,172,485 | B2 | 2/2007 | Thai | |
| 7,182,665 | B2 | 2/2007 | Thai | |
| 7,367,861 | B2 | 5/2008 | Thai | |
| 8,690,630 | B2 * | 4/2014 | Lau | 446/15 |
| 2001/0044252 | A1 | 11/2001 | Cameron | |
| 2007/0037467 | A1 * | 2/2007 | Thai | 446/15 |
| 2008/0299866 | A1 | 12/2008 | Obase | |
| 2009/0149107 | A1 * | 6/2009 | Thai | 446/15 |
| 2009/0227173 | A1 | 9/2009 | Thai | |
| 2012/0270462 | A1 * | 10/2012 | Lo | 446/15 |

* cited by examiner

*Primary Examiner* — Gene Kim
*Assistant Examiner* — Alyssa Hylinski
(74) *Attorney, Agent, or Firm* — Shook, Hardy & Bacon LLP

(57) ABSTRACT

An apparatus for generating bubbles from a stationary loop inside a housing is described. The device includes a housing, a reservoir of bubble-making solution, a fan that generates an air stream, and a pump that supplies said bubble-making solution to a stationary film-producing mechanism. The stationary film-producing mechanism comprises a loop with an opening through which air travels, a film-forming edge, a bubble-releasing edge, a first orifice on an exterior surface of the loop, and a second orifice on an interior surface of the loop. Solution supplied to the film-producing mechanism enters the loop through the first orifice, exits the loop through the second orifice, and forms a film of solution along the film-forming edge of the loop, wherein at least one bubble of solution is released from the bubble-releasing edge.

20 Claims, 10 Drawing Sheets

BUBBLE-BLOWING APPARATUS

SUMMARY

Embodiments of the invention are defined by the claims below, not this summary. A high-level overview of various aspects of the invention are provided here for that reason, to provide an overview of the disclosure, and to introduce a selection of concepts that are further described in the Detailed-Description section below. This summary is not intended to identify key features or essential features of the claimed subject matter, nor is it intended to be used as an aid in isolation to determine the scope of the claimed subject matter. In brief and at a high level, this disclosure describes, among other things, a bubble-blowing apparatus that is configured to dispense bubbles using a stationary loop inside a housing.

DESCRIPTION OF THE DRAWINGS

Illustrative embodiments of the invention are described in detail below with reference to the attached drawing figures, and wherein.

DETAILED DESCRIPTION

Figure 1:
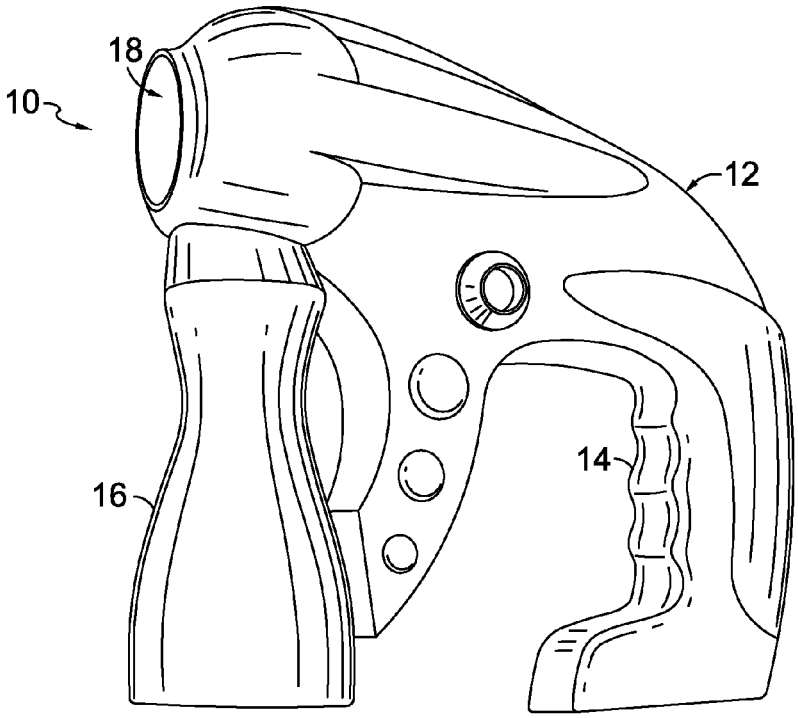
FIG. 1 is a side perspective view of a bubble-blowing apparatus in accordance with an embodiment of the invention.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described.

Embodiments of the invention include an apparatus for blowing bubbles. In embodiments, a bubble-making solution is supplied to a stationary loop that is positioned at an angle to an air outlet inside the housing of the bubble-making apparatus. A film-forming edge on the interior surface of the loop forms a film and/or membrane of solution, as solution flows to the interior surface of the loop. In embodiments, an orifice on the interior surface of the loop is positioned near an apex of the opening of the loop, such as the apex of a teardrop-shaped opening. In some embodiments, the dispensing of bubble-making solution from the internal orifice on a generally concave surface of the loop causes a film of solution to automatically form across the film-forming edge of the loop. Based on the position of the loop relative to the air outlet, the flow of solution from the interior orifice, and the film of bubble-making solution formed on the loop, the air stream flowing from the air outlet causes bubbles to be produced from the bubble solution as they are released from the bubble-releasing edge of the loop. In some embodiments, the apparatus is adapted to retain excess solution flowing out of the interior orifice, and further recycle such unused solution. Additionally, the bubble-making apparatus may be adapted to temporarily discontinue dispensing air when a threshold amount of time has passed during which a film has not been formed on the film-forming edge.

As is known in the art, bubbles can be produced by forming a membrane of a solution, such as, for example, a soap solution, across the interior surface of a ring and blowing a stream of air into the membrane. The air stream stretches the membrane to a point at which the membrane breaks free from the ring and forms a hollow sphere of solution. Any solution capable of producing bubbles in the manner described herein, or by other methods known in the art, is usable with embodiments of the invention. Such solutions include soap solutions and other specially formulated bubble-blowing and/or bubble-making solutions. In one embodiment, the solution is colored with one or more dyes or other colorants to provide a colored bubble, such as the Outdoor Colored Bubbles solution available from Crayola, LLC of Easton, Pa.

Accordingly, in one embodiment, the bubble-blowing apparatus comprises a housing, a reservoir adapted to contain a solution, and a fan disposed in the housing and adapted to generate an air stream that exits the housing through an air outlet. The apparatus further includes a stationary film-producing mechanism and a pump disposed in the housing and connected to the reservoir by a tube to supply said solution to the stationary film-producing mechanism.

In another embodiment, the bubble-blowing apparatus comprises a housing, a reservoir adapted to contain a solution, a fan disposed in the housing and adapted to generate an air stream that exits the housing through an air outlet, and a stationary film-producing mechanism having a loop with an opening through which air from the air outlet travels, wherein the loop comprises an interior film-forming edge and an exterior bubble-releasing edge. The apparatus also includes a pump disposed in the housing and connected to the reservoir by a tube to supply said solution to the stationary film-producing mechanism.

In a further embodiment, a bubble-blowing apparatus comprises a housing, a reservoir adapted to contain a solution, a fan disposed in the housing and adapted to generate an air stream that exits the housing through an air outlet, a stationary film-producing mechanism having a loop with an opening through which air from the air outlet travels, wherein the loop comprises an interior film-forming edge, an exterior bubble-releasing edge, a first orifice on an interior surface of the loop, and a second orifice on an exterior surface of the loop, and a pump disposed in the housing and connected to the reservoir by a tube to supply said solution to the stationary film-producing mechanism, wherein solution supplied to the film-producing mechanism enters the loop through the second orifice, exits the loop through the first orifice, and forms a film of solution along the film-forming edge of the loop, wherein at least one bubble of solution is released from the bubble-releasing edge.

With reference now to the figures, apparatus, methods, and systems for providing a bubble-blowing apparatus are described in accordance with embodiments of the invention. Various embodiments are described with respect to the figures in which like elements are depicted with like numerals.

Figure 2:
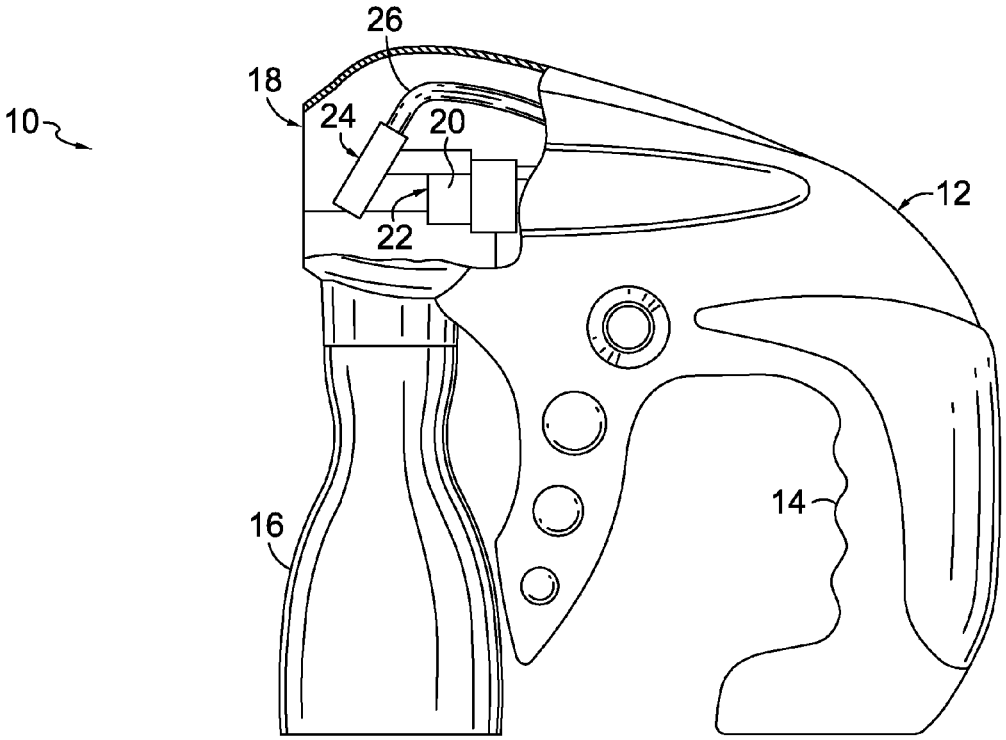
FIG. 2 is side elevational view of a bubble-blowing apparatus, with a portion of the housing cut away, in accordance with an embodiment of the invention.

As depicted in FIGS. 1 and 2, embodiments of the invention include a bubble-blowing apparatus 10 having a housing 12, a handle 14, a reservoir 16 and a housing opening 18, an air outlet 20 with an air outlet opening 22, a loop 24, and tubing 26. Although not depicted in FIGS. 1 and 2, embodiments of the bubble-blowing apparatus include a fan disposed inside the housing that generates an air stream that exits air outlet 20. For example, the air outlet 20 may be coupled to a hand-cranked fan that manually generates an amount of air to exit the bubble-blowing apparatus 10.

In embodiments, reservoir 16 contains a bubble-making solution that can be dispensed from tubing 26 into the loop 24. In some embodiments, one or more hand-cranked mechanisms may be used to power the generation of an air stream and the dispensing of the bubble-making solution using a pump. Accordingly, although not depicted in FIGS. 1 and 2, embodiments of the invention include a pump inside the housing 12, coupled to the reservoir 16 and/or tubing 26.

In embodiments, a bubble generated by the bubble-blowing apparatus 10 exits the housing 12 via the housing opening 18. As shown in FIG. 2, a portion of the housing 12 is cut away to reveal an internal portion of the bubble-blowing apparatus 10. The bubble-blowing apparatus 10 also includes an air outlet 20 having an air outlet opening 22, a loop 24, and tubing 26. In one embodiment, loop 24 is coupled to air outlet 20 in a stationary position such that air exiting the air outlet opening 22 flows through an opening in the loop 24.

Figure 3A:
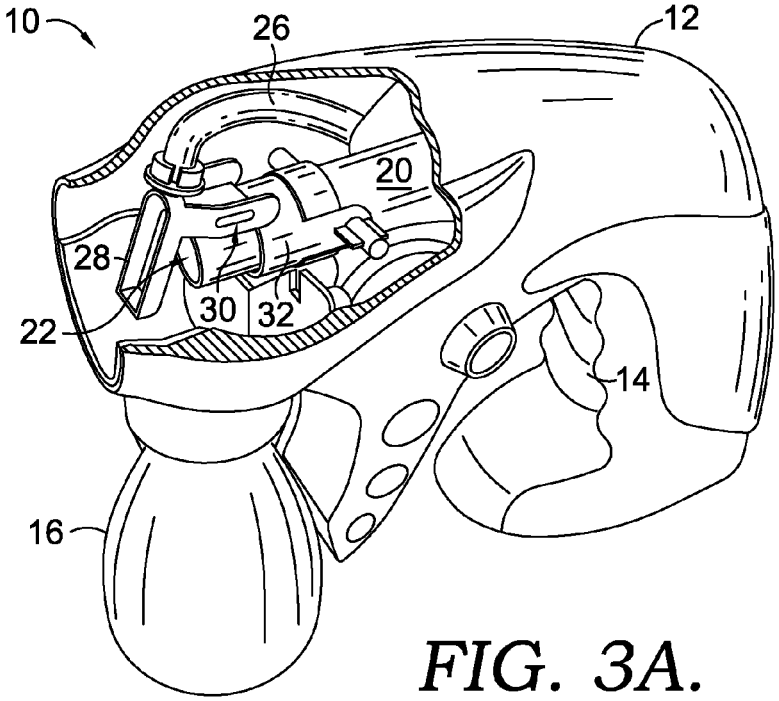
FIG. 3A is a side perspective view of a bubble-blowing apparatus, with a portion of the housing cut away, in accordance with an embodiment of the invention.

Referring next to FIG. 3A, a perspective view of the bubble-blowing apparatus 10 includes a loop 28 that is positioned at an angle with respect to the air outlet 20. In embodiments, loop 28 is stationary with respect to the air outlet 20, by virtue of the stationary attachment formed by one or more positioning and/or attaching devices. For example, positioning device 30 and the attachment device 32 may secure loop 28 at a particular angle, and at a particular distance, from the air outlet 20. In some embodiments, positioning device 30 is coupled directly to both the loop 28 and the attachment device 32.

Figure 3B:
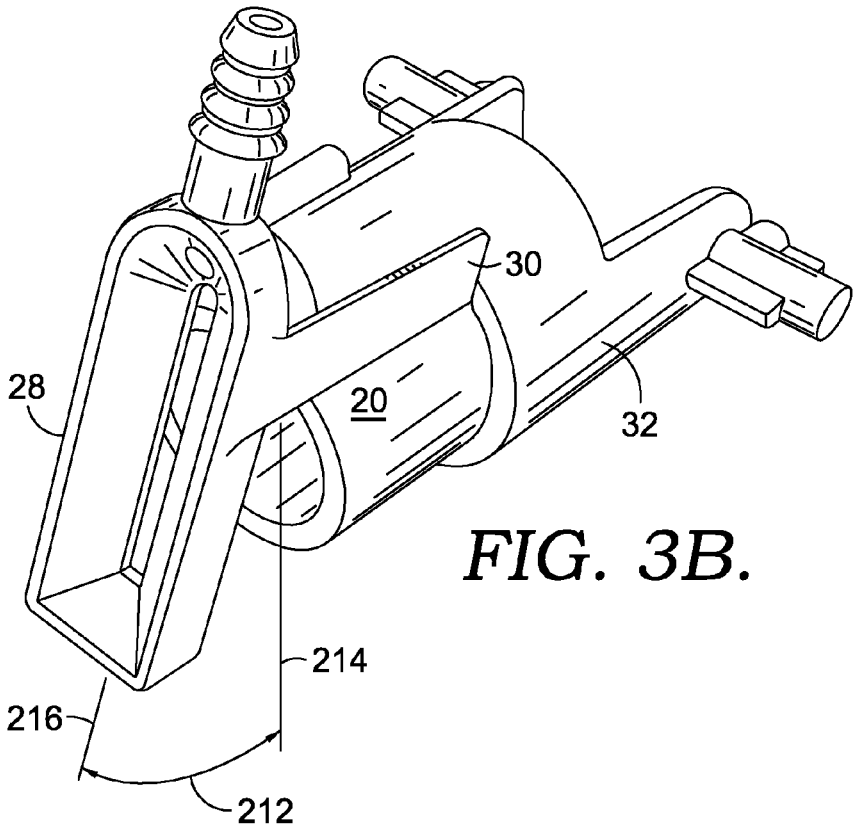
FIG. 3B is a side perspective view of a portion of the bubble-blowing apparatus of FIG. 3A, in accordance with an embodiment of the invention.

FIG. 3B is an enlarged view of a portion of the bubble-blowing apparatus 10 in FIG. 3A, the parts of which may collectively be referred to as a stationary film-producing mechanism. As seen in FIG. 3B, loop 28 is positioned at a particular angle 212 between the plane 214 of the air outlet 20 and the plane 216 of the loop 28. Accordingly, loop 28 is coupled to air outlet 20 in a stationary position and at an angle 212 relative to the source of air that flows through loop 28. Further, such stationary positioning is supported by the coupling of the loop 28 to the air outlet 20 via the positioning device 30 and the attachment device 32. In embodiments, attachment device 32, positioning device 30, and loop 28 may be molded from a single piece. In further embodiments, air outlet 20 may be molded from the same single piece as loop 28, positioning device 30, and/or attachment device 32.

FIGS. 4-29 depict various loop embodiments for positioning inside the housing 12 of the bubble-blowing apparatus 10. Embodiments of the bubble-blowing apparatus include a loop structure having a film-forming edge on an internal portion of the loop, and a bubble-releasing edge near the external edge of the loop. As discussed above, the various loops of these embodiments may be secured in a stationary position with respect to the air outlet.

Figure 4:
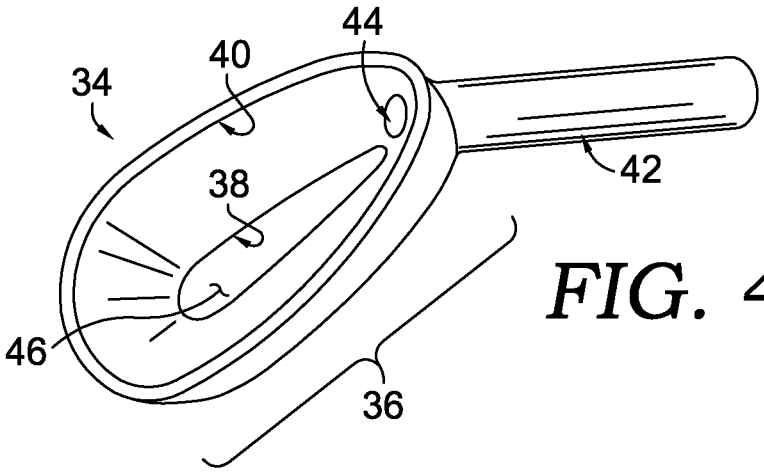
FIG. 4 is a side perspective view of a loop, in accordance with an embodiment of the invention.
Figure 5:
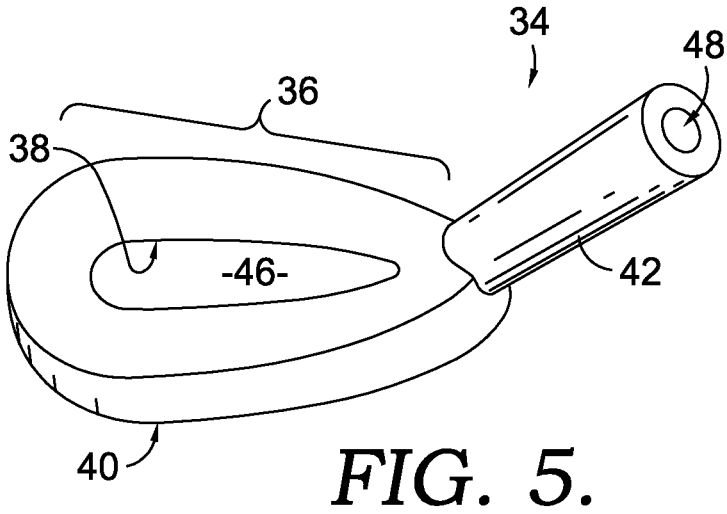
FIG. 5 is a bottom perspective view of the exterior surface of the loop of FIG. 4, in accordance with an embodiment of the invention.

For example, FIGS. 4-5 depict a loop 34 having a loop body 36 with a film-forming edge 38 and a bubble-releasing edge 40, and a portion of tubing 42 coupled to the teardrop-shaped loop body 36. In embodiments, bubble-making solution travels into the loop 34 via the tubing 42 on an exterior surface of the loop, and exits the body of the loop via inside orifice 44 on an interior surface of the loop 34. In some embodiments, tubing connecting the reservoir 16 to the loop 34 (as coupled to tubing 42) may provide bubble-making solution into the loop 34 via a top orifice 48 of the hollow interior of the tubing 42, as best shown in FIG. 5. In embodiments, bubble-making solution (from tubing 42) travels from the inside orifice 44 towards the inside orifice 46, thereby forming a film of bubble-making solution across the film-forming edge 38 of the loop 34. Accordingly, a stream of air blown through the loop opening 46 creates tension against the film formed across the film-forming edge 38, advances such film along the interior surface of the loop 34, and then releases the loop off the bubble-releasing edge 40. In embodiments, an air stream traveling in the direction of stationary loop 34 may stretch the film formed across the film-forming edge 38 to a point at which a hollow sphere of solution (i.e. a bubble) breaks free from the loop 34 (at the bubble-release edge 40).

Figure 6:
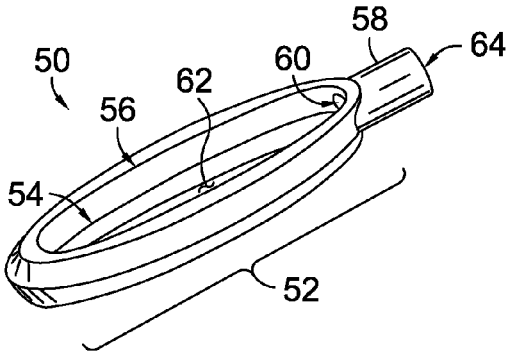
FIG. 6 is a side perspective view of a loop, in accordance with an embodiment of the invention.
Figure 7:
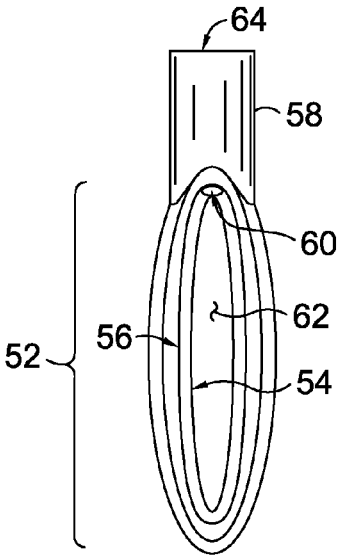
FIG. 7 is a top plan view of the loop of FIG. 6, in accordance with an embodiment of the invention.

Referring next to FIGS. 6-7, loop 50 has an oval-shaped loop body 52 coupled to tubing 58 with an inside orifice 60, a loop opening 62, and a top orifice 64. Bubble-making solution traveling into the top orifice 64 may pass through the tubing 58, travel through the inside orifice 60, and form a film across the film-forming edge 54 of loop 50. In embodiments, an air stream traveling in the direction of stationary loop 50 may stretch the film formed across the film-forming edge 54 to a point at which a bubble of solution breaks free from the loop 50 (at the bubble-release edge 56).

Figure 8:
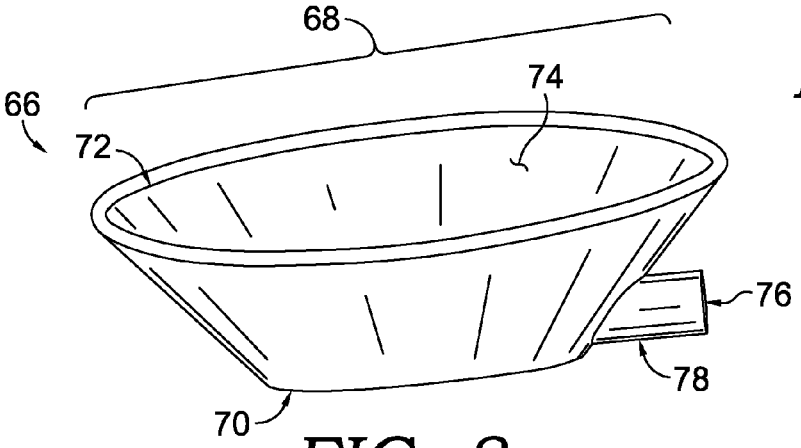
FIG. 8 is a side perspective view of a loop, in accordance with an embodiment of the invention.
Figure 9:
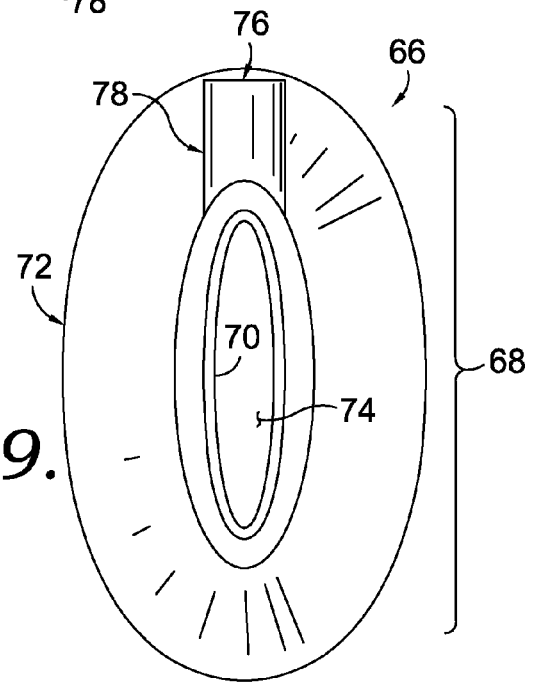
FIG. 9 a bottom plan view of the loop of FIG. 8, in accordance with an embodiment of the invention.

As depicted in FIGS. 8-9, an exemplary loop 66 has a funnel-like shape 68 that tapers from a narrower point at the film-forming edge 70 a wider point at the bubble-releasing edge 72. Accordingly, an air stream traveling through the loop opening 74 may create a bubble based on a bubble-making solution entering the top orifice 76 of the tubing 78, traveling into the loop 66, and exiting on an internal surface of the loop 66 where it forms a film across the film-forming edge 70. The film formed on the film-forming edge 70 may be stretched by the air stream, releasing a bubble of solution from the bubble-releasing edge 72. As will be understood, in embodiments of the invention where a single bubble of solution is released, multiple bubbles of solution may also be generated by the apparatus. For example, while a stream of air flows continuously through loop opening 74 and/or against a film formed along film-forming edge 70, a continuous stream of bubbles may be released from bubble-blowing apparatus 10.

Figure 10:
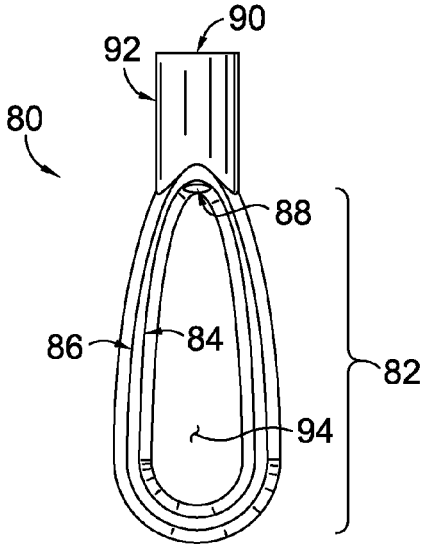
FIG. 10 a top plan view of a loop, in accordance with an embodiment of the invention.
Figure 11:
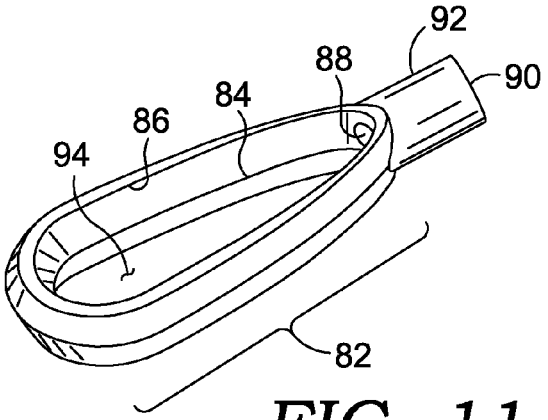
FIG. 11 is a side perspective view of the loop of FIG. 10, in accordance with an embodiment of the invention.

Turning next to FIGS. 10-11, exemplary loop 80 has a teardrop-shaped loop body 82, a film-forming edge 84, a bubble-releasing edge 86, an inside orifice 88, a top orifice 90, tubing 92, and a loop opening 94. Bubble solution flowing into tubing 92 via top orifice 90 may flow through internal orifice 88 and form a film across film-forming edge 84. The film may be stretched and/or expanded when an air stream is directed to the loop opening 94, and a bubble of solution may break free of the loop 80 when released off of the bubble-releasing edge 86. Accordingly, a bubble of solution released from bubble-releasing edge 86 may travel outside the housing of a bubble-blowing apparatus such as bubble-blowing apparatus 10.

Figure 12:
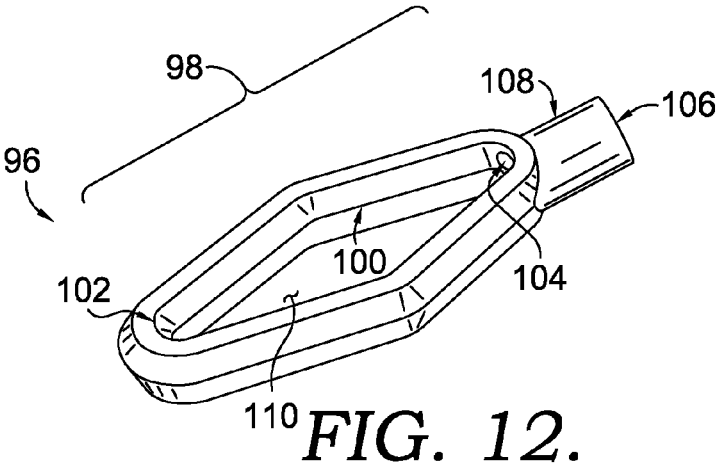
FIG. 12 is a side perspective view of a loop, in accordance with an embodiment of the invention.
Figure 13:
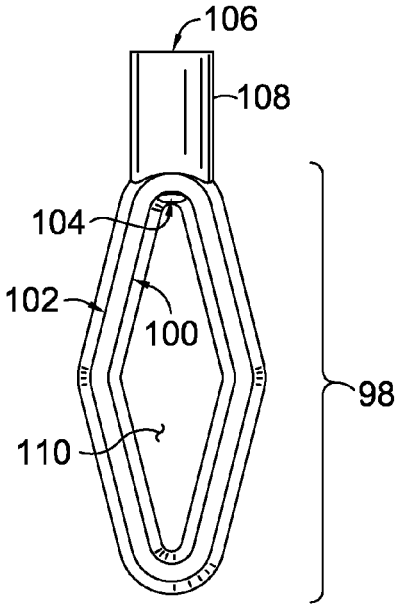
FIG. 13 is a top plan view of the loop of FIG. 12, in accordance with an embodiment of the invention.

With reference to FIGS. 12-13, embodiments of a loop 96 having a diamond-shaped loop body 98, with a film-forming edge 100, a bubble-releasing edge 102, an inside orifice 104, a top orifice 106, and tubing 108. In one example, bubble solution entering tubing 108 via top orifice 106 may wet the interior surface of loop 96 by exiting inside orifice 104 and forming a film across the film-forming edge 100. The film may be stretched and/or expanded when an air stream is directed to the loop opening 110, and a bubble of solution may break free of the loop 96 when released off of the bubble-releasing edge 102.

Figure 14:
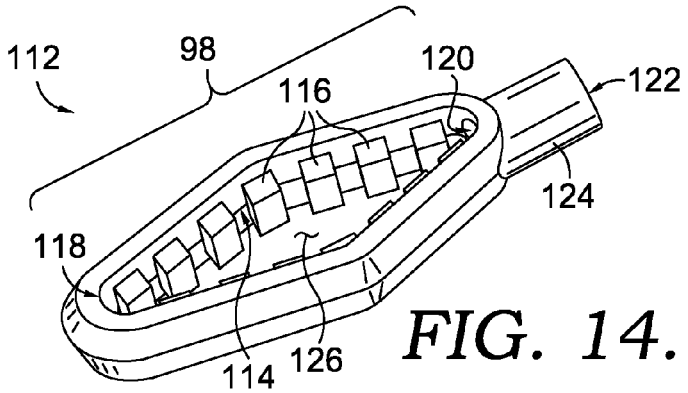
FIG. 14 is a side perspective view of a loop, in accordance with an embodiment of the invention.
Figure 15:
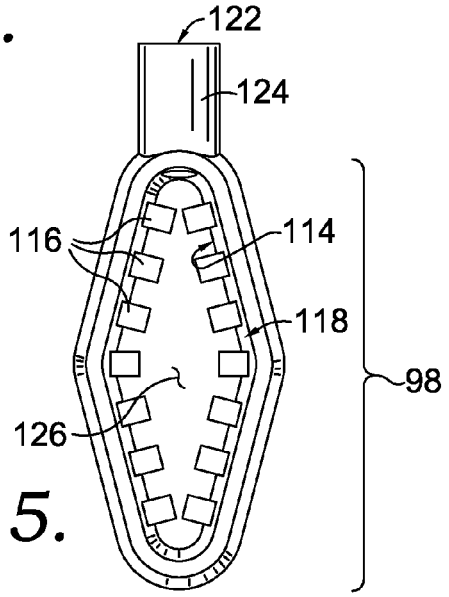
FIG. 15 is a top plan view of the loop of FIG. 14, in accordance with an embodiment of the invention.

In the embodiment of FIGS. 14-15, loop 112 has a diamond-shaped loop body 98 similar to the diamond-shaped loop body 98 of FIGS. 12-13. Additionally, loop 112 includes a film-forming edge 114, a plurality of teeth 116, a bubble-releasing edge 118, an inside orifice 120, a top orifice 122, tubing 124, and loop opening 126. In embodiments, a film is formed along film-forming edge 114 and the plurality of teeth 116 that surround the perimeter of the loop opening 126. In one example, the plurality of teeth 116 enhance the ability of the loop 112 to retain a film of bubble-making solution along film-forming edge 114, and thereby produce one or more bubbles.

Figure 16:
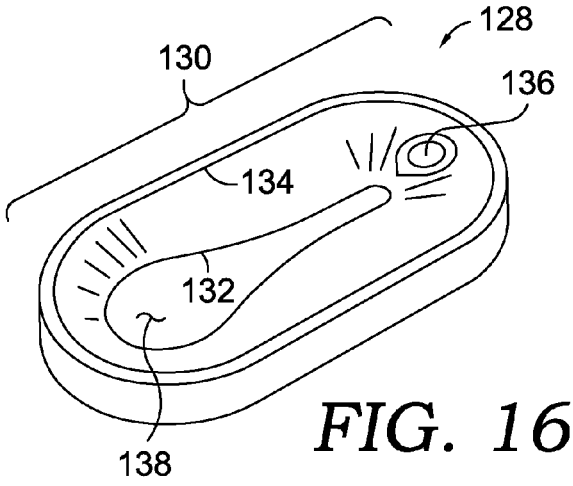
FIG. 16 is a side perspective view of a loop, in accordance with an embodiment of the invention.
Figure 17:
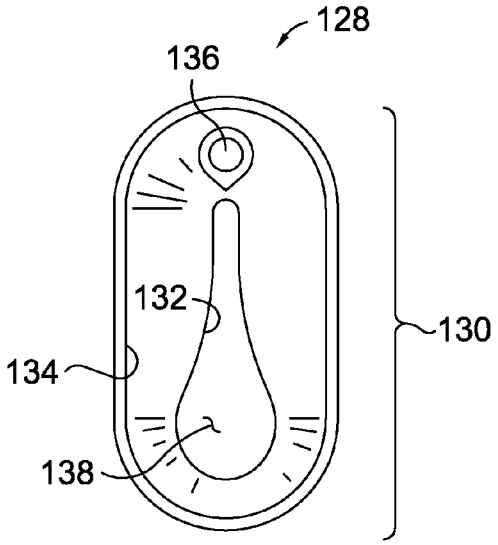
FIG. 17 is a top plan view of the loop of FIG. 16, in accordance with an embodiment of the invention.

In FIGS. 16-17, loop 128 has an oval shape 130, with a film-forming edge 132 on an inner surface of the loop 128. In embodiments, bubble-making solution exits inside orifice 136, forms a film on film-forming edge 132, and releases a bubble of solution from bubble-releasing edge 134 when a stream of air passes through loop opening 138.

Figure 18:
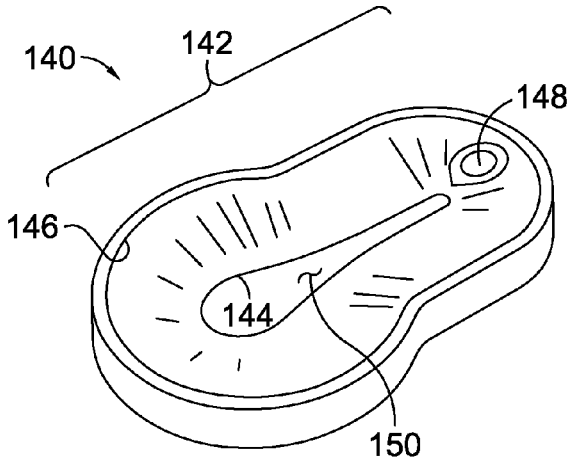
FIG. 18 is a side perspective view of a loop, in accordance with an embodiment of the invention.
Figure 19:
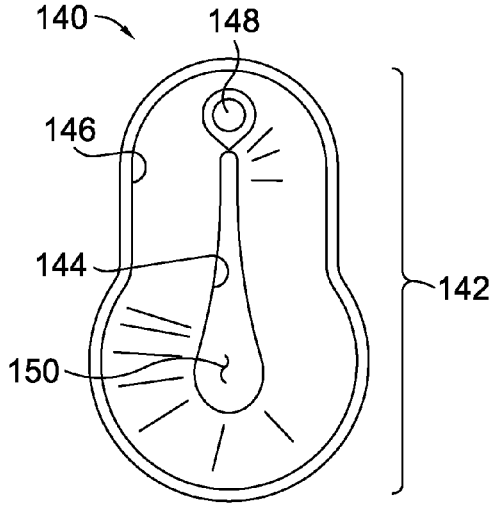
FIG. 19 is a top plan view of the loop of FIG. 18, in accordance with an embodiment of the invention.
Figure 20:
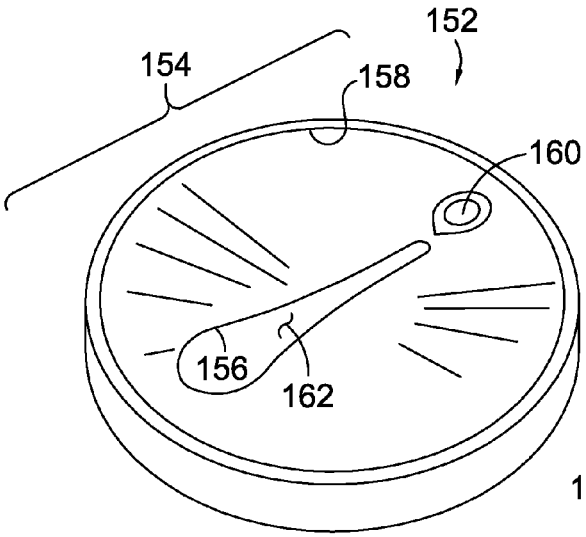
FIG. 20 is a side perspective view of a loop, in accordance with an embodiment of the invention.
Figure 21:
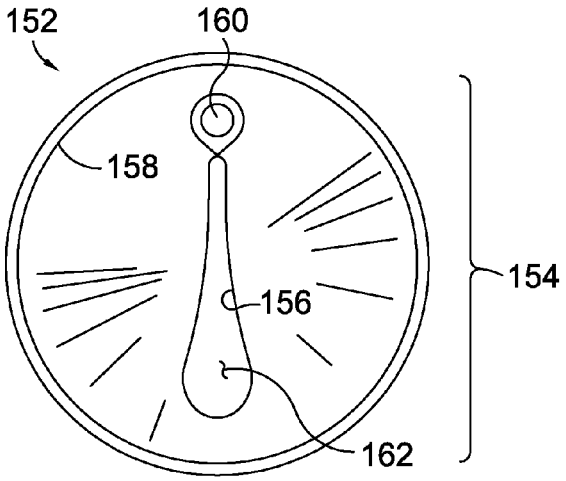
FIG. 21 is a top plan view of the loop of FIG. 20, in accordance with an embodiment of the invention.

Turning now to FIGS. 18-19, a loop 140 has an ovular teardrop shape 142, and includes a film-forming edge 144, a bubble-releasing edge 146, an inside orifice 148, and a loop opening 150. Similarly, FIGS. 20-21 depict an additional embodiment of the invention with a loop 152 having a circular shape 154, a film-forming edge 156, a bubble-releasing edge 158, an internal orifice 160 and a loop opening 162. As shown from the perspective views of FIGS. 18 and 20, the partially-concave internal surfaces of each loop creates an inclined surface that draws bubble-making solution exiting internal orifices 148 and 160 towards the film-forming edges 144 and 156.

Figure 22:
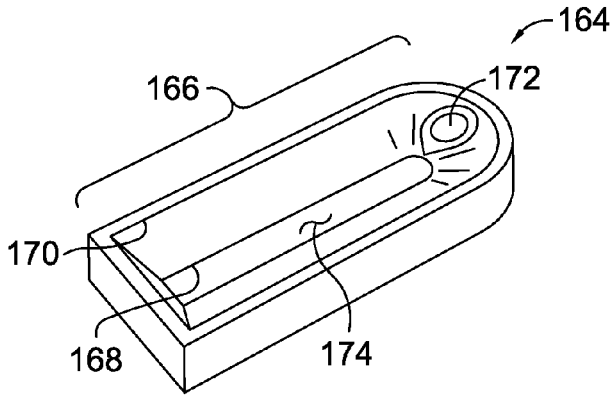
FIG. 22 is a side perspective view of a loop, in accordance with an embodiment of the invention.
Figure 23:
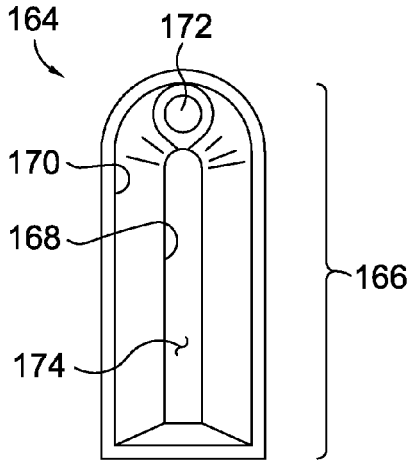
FIG. 23 is a top plan view of the loop of FIG. 22, in accordance with an embodiment of the invention.

With reference now to FIGS. 22-23, a loop 164 has a partially-curved shape 166, with a film-forming edge 168, a bubble-releasing edge 170, an internal orifice 172, and a loop opening 174. In embodiments, bubble-making solution exits internal orifice 172, forms a film on film-forming edge 168, and releases a bubble of solution from bubble-releasing edge 170 when a stream of air passes through loop opening 174.

Figure 24:
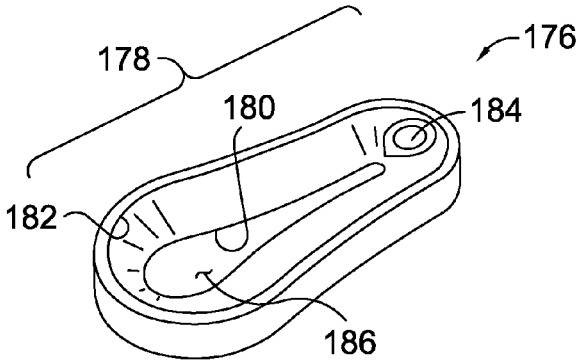
FIG. 24 is a side perspective view of a loop, in accordance with an embodiment of the invention.
Figure 25:
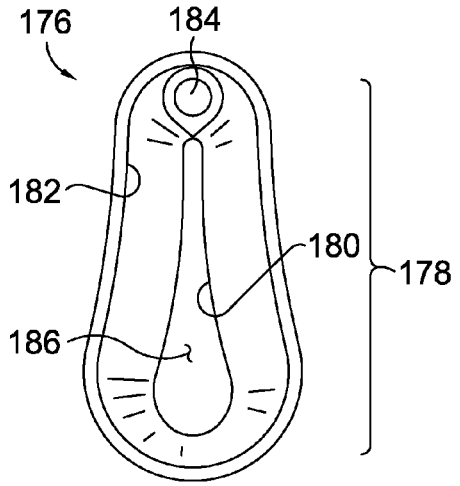
FIG. 25 is a top plan view of the loop of FIG. 24, in accordance with an embodiment of the invention.

In the embodiment of FIGS. 24-25, loop 176 has a rounded teardrop shape 178, with a film-forming edge 180, a bubble-releasing edge 182, an internal orifice 184, and a loop opening 186. In embodiments, bubble-making solution exits internal orifice 184, forms a film on film-forming edge 180, and releases a bubble of solution from bubble-releasing edge 182 when a stream of air passes through loop opening 186.

Figure 26:
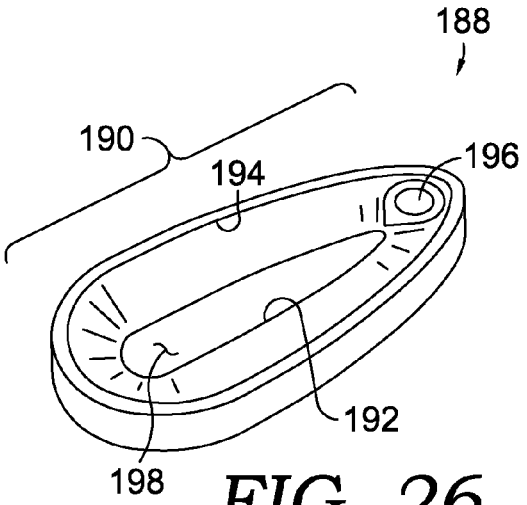
FIG. 26 is a side perspective view of a loop, in accordance with an embodiment of the invention.
Figure 27:
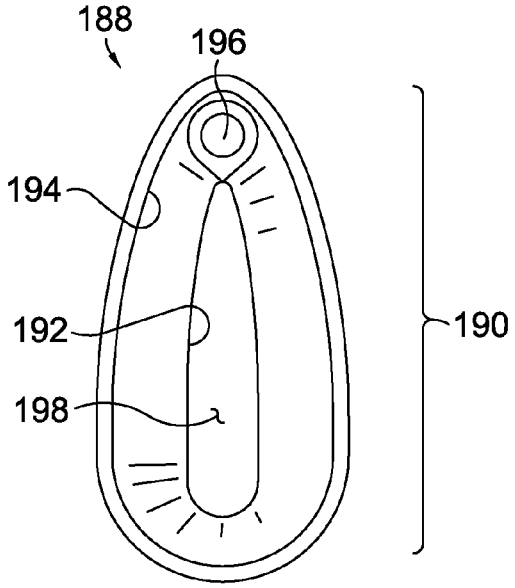
FIG. 27 is a top plan view of the loop of FIG. 26, in accordance with an embodiment of the invention.

Referring now to FIGS. 26-27, embodiments of the invention include a loop 188 having a teardrop shape 190, with a film-forming edge 192, a bubble-releasing edge 194, an internal orifice 196 and a loop opening 198. In one example, bubble solution wets the interior surface of loop 188 by exiting inside orifice 196 and forming a film across the film-forming edge 192. The film may be stretched and/or expanded when an air stream is directed to the loop opening 198, and a bubble of solution may break free of the loop 188 when released off of the bubble-releasing edge 194.

Figure 28:
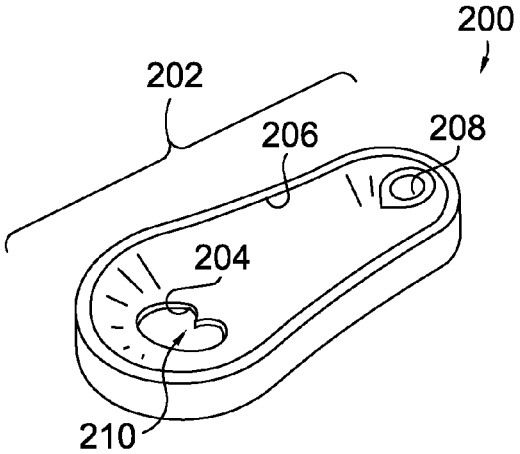
FIG. 28 is a side perspective view of a loop, in accordance with an embodiment of the invention.
Figure 29:
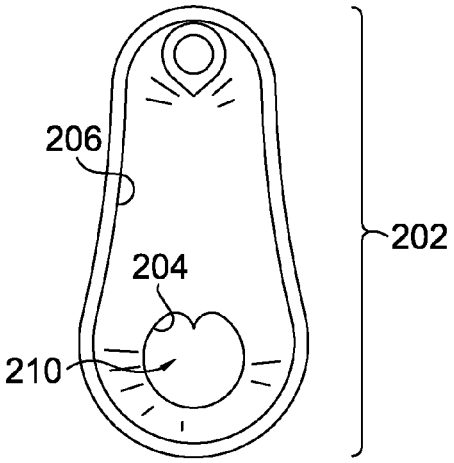
FIG. 29 is a top plan view of the loop of FIG. 29, in accordance with an embodiment of the invention.

With reference to FIGS. 28-29, loop 200 has a rounded-teardrop shape 202, a film-forming edge 204, a bubble-releasing edge 206, an internal orifice 208, and a loop opening 210. As shown from the perspective view of FIG. 28, the partially-concave internal surfaces of loop 200 creates an inclined surface that draws bubble-making solution exiting internal orifice 208 towards the film-forming edge 204. Further, the film formed across film-forming edge 204 may be stretched and/or expanded when an air stream is directed toward the loop opening 210, and a bubble of solution may break free of the loop 200 when released off of the bubble-releasing edge 206. The example of FIGS. 28-29 has a loop shape similar to loop 176 in FIGS. 24-25. However, loop opening 186 has a rounded teardrop shape similar to the rounded teardrop shape 178 of loop 176, while loop opening 210 of FIGS. 28-29 has a rounded shape with a pointed insert.

Figure 30:
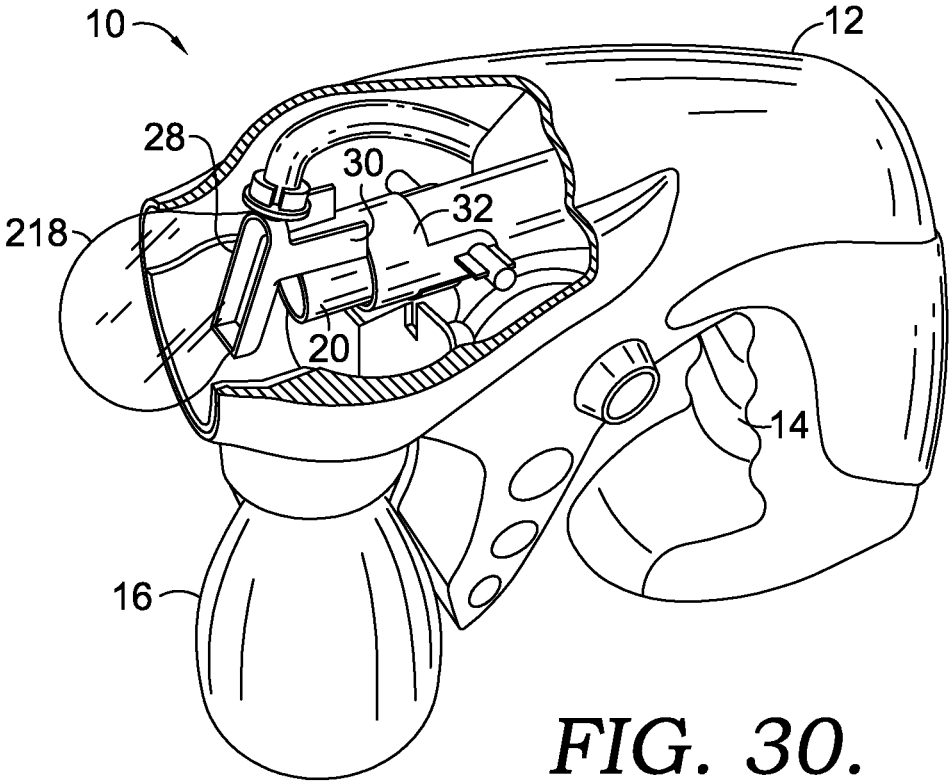
FIG. 30 is a side perspective view of a bubble-blowing apparatus, with a portion of the housing cut away, in accordance with an embodiment of the invention.

Turning next to FIG. 30, an exemplary bubble-blowing apparatus 10 includes a loop 28, as discussed previously with respect to FIG. 3B. In particular, the exemplary bubble blowing apparatus 10 of FIG. 30 includes a loop 28 having a partially-curved shape, which is positioned at an angle from the air outlet 20. This stationary positioning of the loop 28 is stabilized by positioning device 30 and attachment device 32. In embodiments, a single positioning and/or attaching device may be utilized to orient the loop 28 at a particular angle and/or distance relative to the air outlet 20. In other words, a single positioning and/or attachment unit may perform the same functions as the two parts referred to herein as the positioning device 30 and the attachment device 32. In embodiments, attachment device 32 stabilizes the loop 28 with respect to the air outlet 20 by coupling directly to the air outlet 20. It will be understood that, in other embodiments, the loop 28 may be stabilized with respect to the air outlet 20 by using a positioning and/or attachment device that is coupled to a different portion of the bubble-blowing apparatus 10, such as a side of the housing 12.

As shown in the cut-away portion of FIG. 30, a bubble of solution 218 is formed and released from the loop 28. This bubble of solution is then released out of the housing opening. In embodiments, a continuous stream of bubbles 218 are released from loop 28 and projected from the housing 12 of the bubble-making device 10. Further, while a user powers a motor and/or pump associated with the bubble-blowing apparatus 10, air may continue to stream from air outlet 20, solution may continue to flow from reservoir 16, and multiple bubbles 218 may be generated. In embodiments, bubble-making solution from reservoir 16 travels to an opening on an external surface of the loop 28. The solution then exits on an internal surface of the loop 28, such as internal orifice 172 on loop 164, and forms a film on the film-forming edge of the loop 28, such as film-forming edge 168 on loop 164. Additionally, a stream of air passes through the opening of the loop 28, such as the opening 174 of loop 164, and releases a bubble of solution from bubble-releasing edge 170. Accordingly, in embodiments of the invention, a film is formed on the film-forming edge of a loop, and released off of the bubble-releasing edge of the loop, while maintaining a stabilized position with respect to the air outlet of the bubble-blowing apparatus 10.

In further embodiments, the bubble-making solution is "fed" into the loop from an exterior surface of the loop, such as the top, back or other side of the loop that is distinct from the internal surface of the loop where the internal orifice is positioned. In some embodiments, the internal orifice is positioned near an apex of the opening of the loop, such as in FIGS. 4-27. Accordingly, the solution flowing from the internal orifice may be drawn to the film-forming edge of the loop opening. In some embodiments, the partially-concave internal surface of a loop creates an inclined surface that draws bubble-making solution exiting the internal orifices towards the film-forming edges. Accordingly, the dispensing of bubble making solution from the internal orifice automatically forms a film across the film-forming edge of the stationary loop, for generation of bubbles.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

The invention claimed is:

1. A bubble-blowing apparatus comprising:
- a housing;
- a reservoir adapted to contain a solution;
- a fan disposed in the housing and adapted to generate an air stream that exits the housing through an air outlet;
- a stationary film-producing mechanism comprising a loop, wherein the loop comprises:
  - a film-forming edge oriented in a proximal first plane,
  - a bubble-releasing edge oriented in a distal second plane opposite the proximal first plane,
  - a first orifice on an exterior surface of the loop;
  - a second orifice on an interior surface of the loop; and
- a pump disposed in the housing and connected to the reservoir by a tube to supply said solution to the stationary film-producing mechanism.

2. The apparatus of claim 1, wherein solution flowing from the reservoir to the film-producing mechanism
- (1) travels through the tube and enters the loop through the first orifice;
- (2) exits the loop through the second orifice; and
- (3) forms a film of solution along the film-forming edge of the loop in the proximal first plane, the film-forming edge comprising a third orifice, wherein at least one bubble of solution is released from the bubble-releasing edge.

3. The apparatus of claim 2, wherein air flowing through the air outlet passes through the third orifice and causes the film of solution to travel from the film-forming edge to the bubble-releasing edge of the loop.

4. The apparatus of claim 3, wherein at least one bubble is released from the bubble-release edge.

5. The apparatus of claim 1, wherein the film-producing mechanism is positioned at an angle relative to the air outlet.

6. The apparatus of claim 1, wherein the loop tapers from a narrower point at the film-forming edge to a wider point at the bubble-releasing edge.

7. The apparatus of claim 1, wherein at least a portion of the loop comprises a concave surface between the film-forming edge and the bubble-releasing edge.

8. The apparatus of claim 7, wherein the concave surface comprises an inclined surface configured to draw bubble-making solution exiting the second orifice towards the film-forming edge.

9. A bubble-blowing apparatus comprising
- a housing;
- a reservoir adapted to contain a solution;
- a fan disposed in the housing and adapted to generate an air stream that exits the housing through an air outlet;
- a stationary film-producing mechanism having a loop with an opening through which air from the air outlet travels, wherein the loop comprises a film-forming edge oriented in a proximal first plane and a bubble-releasing edge oriented in a distal second plane opposite the proximal first plane; and
- a pump disposed in the housing and connected to the reservoir by a tube to supply said solution to the stationary film-producing mechanism.

10. The apparatus of claim 9, wherein the loop comprises a first orifice on an exterior surface of the loop and a second orifice on an interior surface of the loop.

11. The apparatus of claim 10, wherein solution supplied to the film-producing mechanism enters the loop through the first orifice, exits the loop through the second orifice, and forms a film of solution along the film-forming edge of the loop, wherein at least one bubble of solution is released from the bubble-releasing edge.

12. The apparatus of claim 11, wherein the opening of the loop has a teardrop shape comprising an inclined surface configured to draw the solution exiting the second orifice towards the film-forming edge of the loop.

13. The apparatus of claim 9, wherein the opening of the loop has an apex in proximity to the first orifice.

14. The apparatus of claim 9 further comprising a retention compartment adapted to retain excess solution flowing out of the first orifice.

15. The apparatus of claim 9, wherein the apparatus is adapted to temporarily discontinue dispensing air when a threshold amount of time has passed during which a film has not been formed on the film-forming edge.

16. The apparatus of claim 9, wherein the film-producing mechanism is positioned at an angle relative to the air outlet.

17. A bubble-blowing apparatus comprising:

a housing;

a reservoir adapted to contain a solution;

a fan disposed in the housing and adapted to generate an air stream that exits the housing through an air outlet;

a stationary film-producing mechanism having a loop with an opening through which air from the air outlet travels, wherein the loop comprises an interior film-forming edge oriented in a proximal first plane on a first side of the loop, an exterior bubble-releasing edge oriented in a distal second plane on a second side of the loop, a first orifice on an exterior surface of the loop, a second orifice on an interior surface of the loop, and a third orifice on the bubble-releasing edge; and a pump disposed in the housing and connected to the reservoir by a tube to supply said solution to the stationary film-producing mechanism, wherein solution supplied to the film-producing mechanism enters the loop through the second orifice, exits the loop through the first orifice, and forms a film of solution along the film-forming edge of the loop, wherein at least one bubble of solution is released from the bubble-releasing edge upon travel of the air stream through the third orifice in a direction from the first side of the loop to the second side of the loop.

18. The apparatus of claim 17, wherein the opening of the loop has an apex in proximity to the first orifice.

19. The apparatus of claim 17, wherein the film-producing mechanism is positioned at an angle relative to an opening of the air outlet.

20. The apparatus of claim 17, further comprising a retention compartment coupled to the reservoir, wherein the retention compartment is adapted to retain excess solution flowing out of the first orifice that does not form a film across the film-forming edge.

* * * * *